US006360662B1

(12) United States Patent
Busshoff

(10) Patent No.: US 6,360,662 B1
(45) Date of Patent: Mar. 26, 2002

(54) BRIDGE MANDREL FOR FLEXOGRAPHIC PRINTING SYSTEMS

(75) Inventor: Mario Busshoff, Town Ahaus (DE)

(73) Assignee: Day International, Inc., Dayton, OH (US)

( * ) Notice: Subject to any disclaimer, the term of this patent is extended or adjusted under 35 U.S.C. 154(b) by 0 days.

(21) Appl. No.: 09/528,076

(22) Filed: Mar. 17, 2000

(51) Int. Cl.[7] ..... B41F 13/10
(52) U.S. Cl. ..... 101/375; 101/376; 101/216
(58) Field of Search ..... 101/375, 376, 101/401.1, 212, 216, 389.1, 485, 486, DIG. 36; 492/4, 48, 49, 56

(56) References Cited

U.S. PATENT DOCUMENTS

| | | | | |
|---|---|---|---|---|
| 3,166,013 A | | 1/1965 | Wyllie et al. | |
| 4,491,082 A | * | 1/1985 | Barch et al. | 118/234 |
| 4,583,460 A | | 4/1986 | Maslin et al. | |
| 5,544,584 A | | 8/1996 | Thompson et al. | |
| 5,706,731 A | | 1/1998 | Francille et al. | |
| 5,782,181 A | | 7/1998 | Rossini | |
| 5,819,657 A | | 10/1998 | Rossini | |
| 5,860,360 A | * | 1/1999 | Lane et al. | 101/376 |
| 5,904,095 A | | 5/1999 | Nelson | |

FOREIGN PATENT DOCUMENTS

| | | |
|---|---|---|
| DE | 19903220 A | 8/2000 |
| EP | 0510744 A | 10/1992 |
| EP | 0987109 A | 3/2000 |

OTHER PUBLICATIONS

"Rationalisierung mit Hulsen", Papier & Kunststoffverarbeiter, vol. 5, May 26, 1991.

* cited by examiner

*Primary Examiner*—John S. Hilten
*Assistant Examiner*—Kevin D. Williams
(74) *Attorney, Agent, or Firm*—Killworth, Gottman, Hagan & Schaeff, L.L.P.

(57) ABSTRACT

A bridge mandrel construction is provided which is simple to manufacture, light weight, and easy to mount and dismount from underlying printing cylinders in flexographic and gravure printing systems. The bridge mandrel includes a generally hollow, cylindrically-shaped tube adapted to fit over a print cylinder. A channel extends substantially around the circumference of the inner surface of the tube, and a plurality of orifices extends generally radially outwardly from the channel to the outer surface of the tube. The channel and orifices permit pressurized air to be provided from the interior of the mandrel to its surface for the mounting of a print sleeve onto the mandrel. In one embodiment, the bridge mandrel includes a locking mechanism which is adapted to engage the print cylinder to prevent movement of the mandrel during printing operations.

14 Claims, 4 Drawing Sheets

BRIDGE MANDREL FOR FLEXOGRAPHIC PRINTING SYSTEMS

BACKGROUND OF THE INVENTION

The present invention relates to an intermediate sleeve which is adapted for use in flexographic or gravure printing systems, and more particularly to a bridge mandrel which is adapted to be mounted onto a printing cylinder and adapted to receive replaceable printing sleeves in flexographic or gravure printing systems.

In a typical flexographic printing process, a flexographic printing plate is attached to a cylinder, and as the cylinder rotates, the inked plate provides an image onto a substrate carried on an impression drum. The art conventionally provides the printing plate in the form of a printing sleeve which is expandable by air pressure for mounting and demounting onto the print cylinder. Typical flexography presses operate at high speeds, sometimes printing over 600 linear feet of paper per minute. These high printing speeds require that the print cylinders and sleeves also rotate at high speeds. The construction of the printing cylinders and printing sleeves can vary, and different constructions have been used to attempt to optimize their printing performance.

As known in the art, the diameter of the inner surface of an air-mounted printing sleeve must be slightly smaller than the diameter of the outer surface of the printing cylinder. The difference in these diameters is a dimension known as the interference fit. Moreover, the diameter of the inner surface of the printing sleeve must be expandable by the provision of pressurized air between the opposed surfaces of the sleeve and the printing cylinder in order to mount such printing sleeves onto the printing cylinders as well as remove the sleeves therefrom.

Typically, a printing job will involve an "image repeat," which is the circumferential length of the text and graphics that are to be printed one or more times on the substrate with each revolution of the printing sleeve. The circumference of the printing sleeve must be large enough to contain at least one image repeat. The sleeve repeat, which is equivalent to the sleeve's circumference (including the printing plate mounted on the sleeve), can contain a number of image repeats. Different printing jobs involve image repeats that differ in size, and different printing jobs require sleeve repeats that differ in size. The larger sleeve repeat sizes require printing sleeves with larger circumferences, which means larger outer diameters. When a "converter," i.e., the operator of the machinery that uses a printing sleeve, orders a printing sleeve that is set up with the printing plates for a job that demands a given sleeve repeat size, the inner diameter of that printing sleeve is determined based on the outer diameter of the printing cylinders on hand in that converter's inventory. This is because the printing sleeve must be mounted on a printing cylinder that has a commensurate outer diameter.

To perform a job that requires a large sleeve repeat size, the diameter of the outer surface of the printing sleeve must be large enough to yield the large sleeve repeat size. This requires printing cylinders with larger outer diameters to support thin printing sleeves. However, new printing cylinders are expensive. As one alternative to incurring this expense, thicker printing sleeves resulting from multiple layers are used instead of the single layer, so-called "thin" sleeves. Thompson et al (U.S. Pat. No. 5,544,584) and Maslin et al (U.S. Pat. No. 4,583,460) describe multi-layer printing sleeves that can be mounted on relatively smaller diameter printing cylinders. Such multi-layer printing sleeves have the effect of reducing the inner diameter of the sleeve so that the sleeve can be mounted on a smaller diameter printing cylinder that is already available in the converter's inventory. Multi-layer sleeves are less expensive than printing cylinders, but more expensive than thin sleeves.

Moreover, it is more costly in labor to change printing cylinders on the printing machinery than it is to change printing sleeves on a printing cylinder. However, this solution has lead to a proliferation of multi-layer printing sleeves, which are more costly than the thin sleeves.

In other sleeve-mounting systems, larger repeat sizes can be printed using a thin sleeve mounted on an intermediate sleeve, also known as a bridge mandrel, that can be provided with pressurized air to mount and dismount the thin printing sleeve. In one such bridge mandrel system, as described in Rossini, U.S. Pat. No. 5,819,657, the mandrel is provided with internal "plumbing" in the form of air inlets, fittings, and passageways so that air may be supplied to its outer surface. One major disadvantage of this type of bridge mandrel construction is that it must have a relatively thick wall to accommodate the "plumbing." This makes the bridge mandrel relatively heavy as well as increasing its cost to manufacture. Nelson, U.S. Pat. No. 5,904,095, also describes a similar mandrel construction which includes internal air passages.

Another type of bridge mandrel simply provides a relatively thin spacer sleeve open at both ends and equipped with air holes such as the sleeve described in Rossini, U.S. Pat. No. 5,782,181. However, in order for pressurized air to be supplied, the mandrel must be fitted with plugs at either end to seal those ends, or, the air hole pattern on the mandrel must be carefully aligned with the air hole pattern on an underlying print cylinder. However, as there are no standard air hole patterns in the art, it becomes problematic to achieve proper air hole alignment in all cases.

Accordingly, there remains a need in this art for a bridge mandrel construction which is simple to manufacture, light weight, and easy to mount and dismount from underlying printing cylinders in flexographic and gravure printing systems.

SUMMARY OF THE INVENTION

The present invention meets that need by providing a bridge mandrel construction which is simple to manufacture, light weight, and easy to mount and dismount from underlying printing cylinders in flexographic and gravure printing systems. According to one aspect of the present invention, a bridge mandrel is provided and includes a generally hollow, cylindrically-shaped tube adapted to fit over a print cylinder. The tube has an inner surface and an outer surface, a first end and a second end. A channel extends substantially around the circumference of the inner surface of the tube, and a plurality of orifices extends generally radially outwardly from the channel to the outer surface of the tube. The channel and orifices permit pressurized air to be provided from the interior of the mandrel to its surface for the mounting of a print sleeve onto the mandrel.

In a preferred embodiment, the channel is located adjacent the first end of the tube. The bridge mandrel preferably comprises a base layer, an intermediate layer, and a surface layer. The base layer preferably comprises a metal or a rigid polymer, the intermediate layer preferably comprises a foamed polymeric material (which may be either rigid or compressible), and the surface layer preferably comprises a rigid polymer. The intermediate layer of foamed polymeric material makes the mandrel light in weight, yet the rigid inner and outer layers provide a sturdy construction.

The channel preferably has a depth of between about 0.05 to about 0.5 mm and a width of from between about 1 to about 20 mm. The orifices preferably have a diameter of between about 1.0 to about 2.5 mm. Because the channel extends substantially about the circumference of the inner surface of the tube, there is no need to align the orifices on the mandrel with corresponding air holes on the print cylinder. Air under pressure from the interior of the print cylinder escapes into the channel and finds its way out of the orifices. Thus, there is no need, as in the prior art, for any alignment of the orifices on the mandrel with those on the print cylinder. Nor is there any escape of pressurized air out of the channel. The present invention eliminates the need for tedious alignment of bridge mandrel and print cylinder orifices, or the provision for standard orifice location and spacing on various print cylinders and bridge mandrels.

In accordance with another aspect of the present invention, the bridge mandrel includes a notch on the inner surface of the tube, with the notch adapted to engage a corresponding pin on the print cylinder. Thus, when the bridge mandrel is mounted onto the print cylinder, it may be locked thereto so that there is no movement between the mandrel and print cylinder surfaces. In a preferred embodiment, the notch is generally C-shaped such that the mandrel and print cylinder are locked together by a simple twist of the mandrel. The mandrel may be readily unlocked and removed by simply reversing the procedure. Thus, the invention includes, in combination, a print cylinder and a bridge mandrel assembly, the bridge mandrel including a locking mechanism adapted to releasably secure the bridge mandrel to the print cylinder. The mandrel is readily removable from the print cylinder, and another mandrel having a different outer diameter can easily replace it.

In use, the print cylinder and bridge mandrel assembly are designed so that a print sleeve having at least a radially expandable inner surface may be mounted onto the bridge mandrel by the application of air supplied under pressure through the orifices in the print cylinder and the tube. The print sleeve typically will have either raised (flexographic) or depressed (gravure) areas on its surface to carry ink in a printing process. Once a printing job has been completed, the print sleeve is easily removed by the use of pressurized air.

Accordingly, it is a feature of the present invention to provide a bridge mandrel construction which is simple to manufacture, light weight, and easy to mount and dismount from underlying printing cylinders in flexographic and gravure printing systems. This, and other features and advantages of the present invention, will become apparent from the following detailed description, the accompanying drawings, and the appended claims.

BRIEF DESCRIPTION OF THE DRAWINGS

The present invention will be more readily understood by reference to the accompanying drawing figures which are provided by way of non-limiting example and in which.

DETAILED DESCRIPTION OF THE PREFERRED EMBODIMENTS

Figure 1:
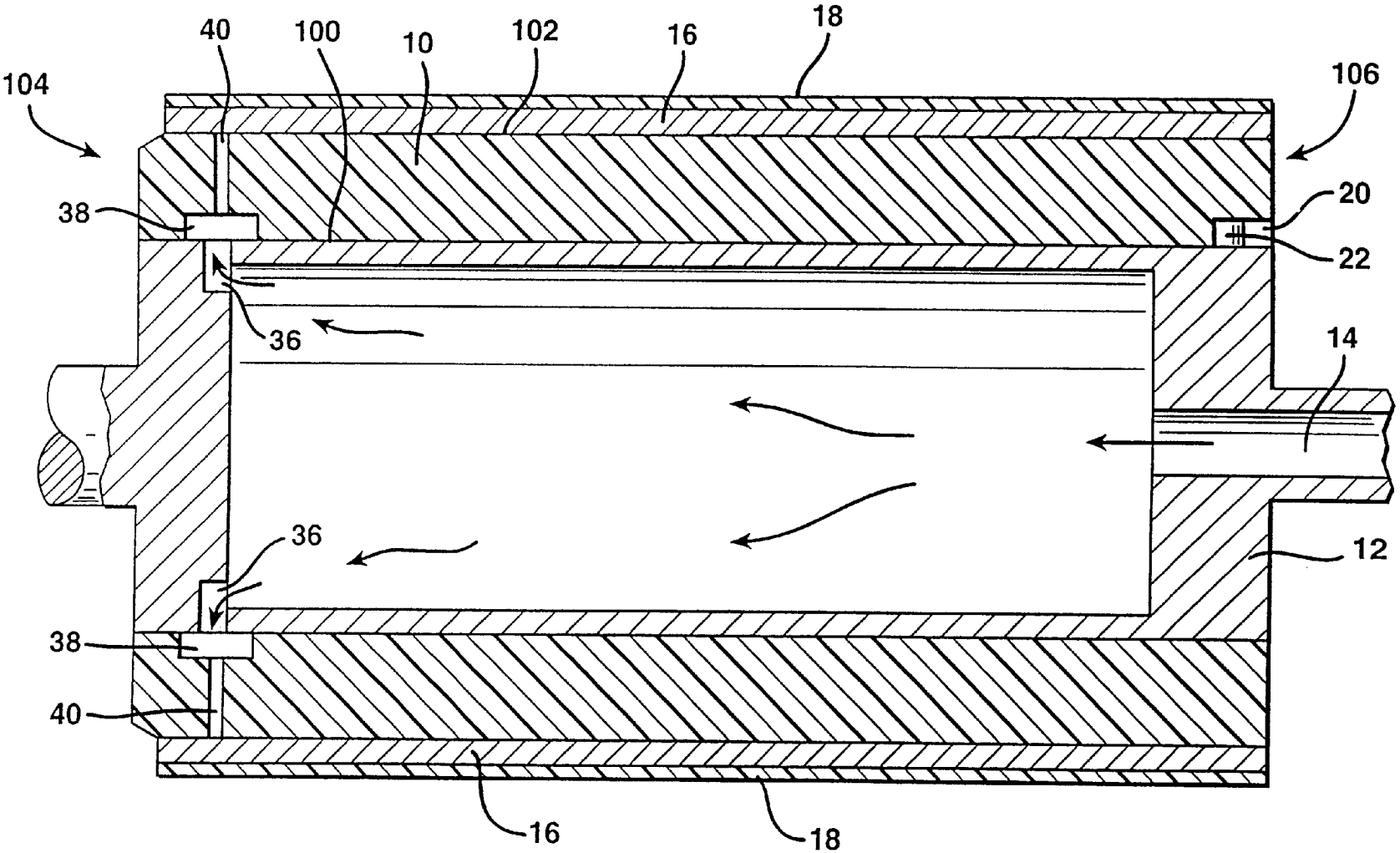
FIG. 1 is a side view in section of an assembly of one embodiment of the mandrel of the present invention mounted onto a printing cylinder, with a printing sleeve mounted onto the mandrel.

The present invention relates to a bridge mandrel construction which is simple to manufacture, light weight, and easy to mount and dismount from underlying printing cylinders in flexographic and gravure printing systems. Referring now to FIG. 1, an embodiment of the bridge mandrel is illustrated in which bridge mandrel 10 is mounted onto print cylinder 12. Bridge mandrel 10 is generally in the shape of a cylindrically-shaped hollow tube having an inner surface 100, an outer surface 102, and first and second ends 104 and 106, respectively.

Print cylinder 12 is mounted for rotation about its longitudinal axis, and, in use, would be a part of a printing press or other print system (not shown). An air inlet 14 is provided which supplies air under pressure into the interior of the print cylinder from a source (not shown). In the embodiment illustrated in FIG. 1, a printing sleeve 16 carries a printing plate 18. Depending on the desired end use, the indicia on printing plate 18 can be raised for flexographic printing or recessed for gravure-type printing. The printing plate surface is designed to be inked, as is conventional, and the inked image transferred to a substrate such as a sheet or continuous web.

Because there has been a demand for print jobs of varying lengths, bridge mandrel 10 is designed to be readily mounted and dismounted from print cylinder 12. As new print jobs are processed, bridge mandrels having different outer diameters, but common inner diameters, can be exchanged by the press operator to provide the correct outer diameter, and thus the correct repeat length, for the desired printing sleeve.

As shown in FIG. 1, bridge mandrel 10 is mounted over print cylinder 12. The inner diameter of mandrel 10 and the outer diameter of cylinder 12 are matched such that there is a close interference fit. The assembly may be linked together by means of a locking mechanism which is adapted to releasably secure the mandrel to the cylinder. A preferred locking mechanism is shown in FIGS. 1, 4A–4C, 5, and 6 and comprises a generally C-shaped notch 20 positioned at one end of the mandrel on an inner surface thereof. A corresponding pin 22 is adapted to fit into notch 20 as the mandrel 10 is fitted onto print cylinder 12. Notch 20 includes a sidewall 24, a back wall 26, and a laterally-extending wall 28.

Figure 4A:
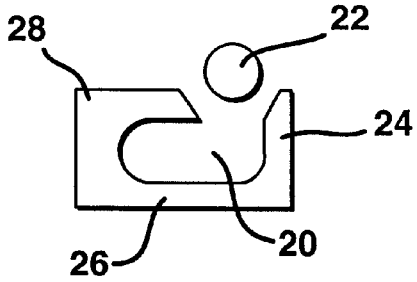
FIGS. 4A through 4C are schematic illustrations of the manner in which a preferred locking mechanism on the mandrel and print cylinder operate.
Figure 4B:
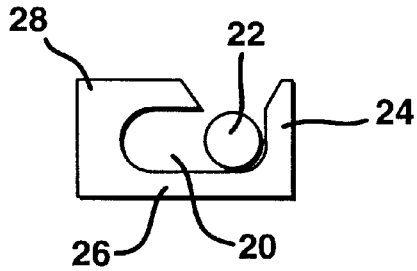
Figure 4C:
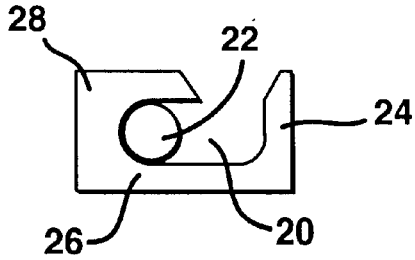
Figure 5:
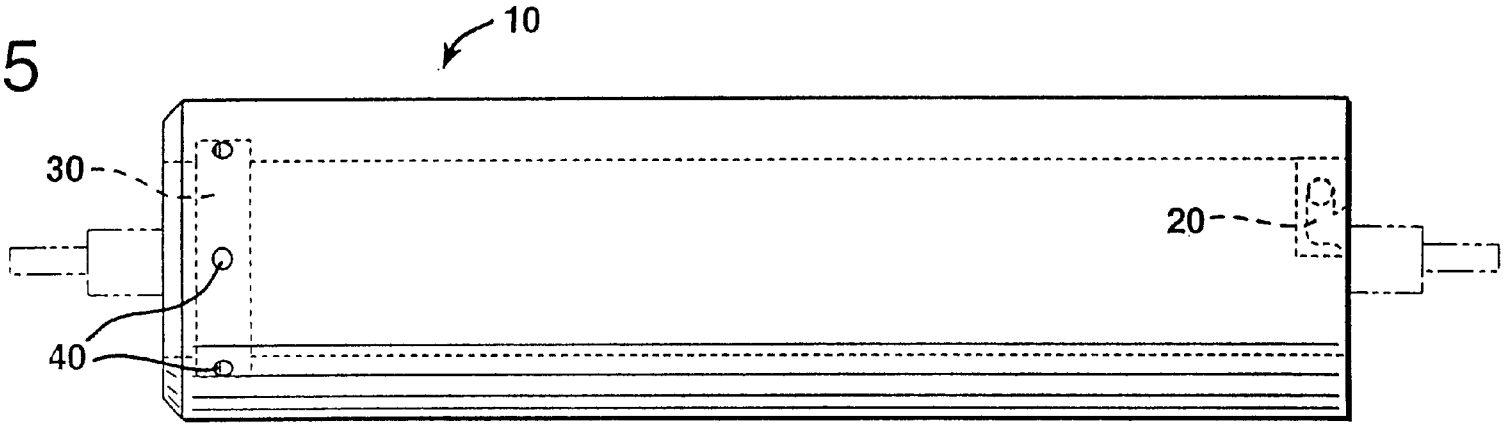
FIG. 5 is a side view, in elevation, illustrating the mandrel mounted and locked onto a print cylinder.
Figure 6:
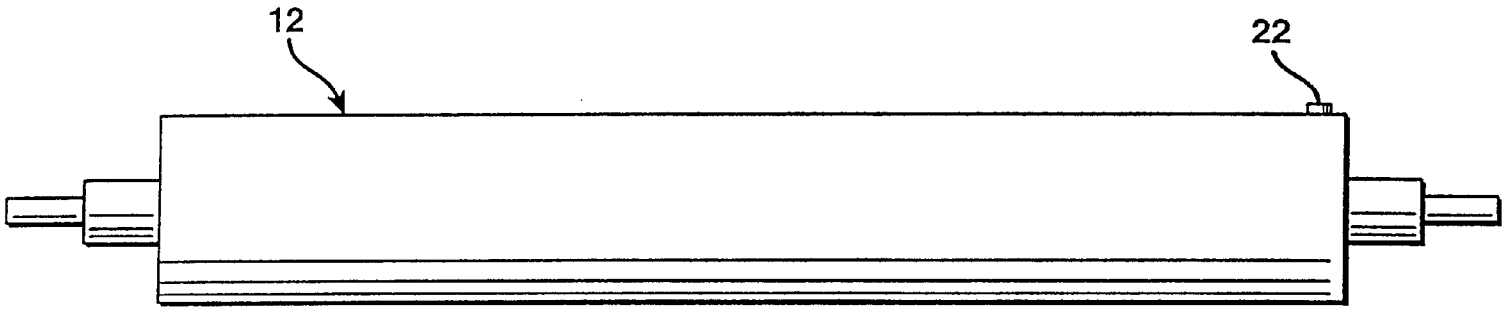
FIG. 6 is a side view, in elevation, illustrating a print cylinder having a pin adapted to lock with the locking mechanism on the mandrel.

The sequence is schematically illustrated in FIG. 4, with the final assembly shown in FIG. 5. As shown, mandrel 10 is positioned and slid onto the print cylinder with the opening in notch 20 in alignment with pin 22 (see, FIG. 4A). Mandrel 10 continues to slide onto the print cylinder until pin 22 engages back wall 26 as shown in FIG. 4B. Then, mandrel 10 is twisted in a clockwise direction as shown such that pin 22 becomes seated in notch 22 between back wall 26 and laterally-extending wall 28 as shown in FIG. 4C, to provide an assembly as illustrated in FIG. 5. Mandrel 10 can be readily dismounted from cylinder 12 by simply reversing the procedure. Of course, those skilled in the art will realize that other locking mechanisms may be used other than the specific structures shown.

Figure 3:
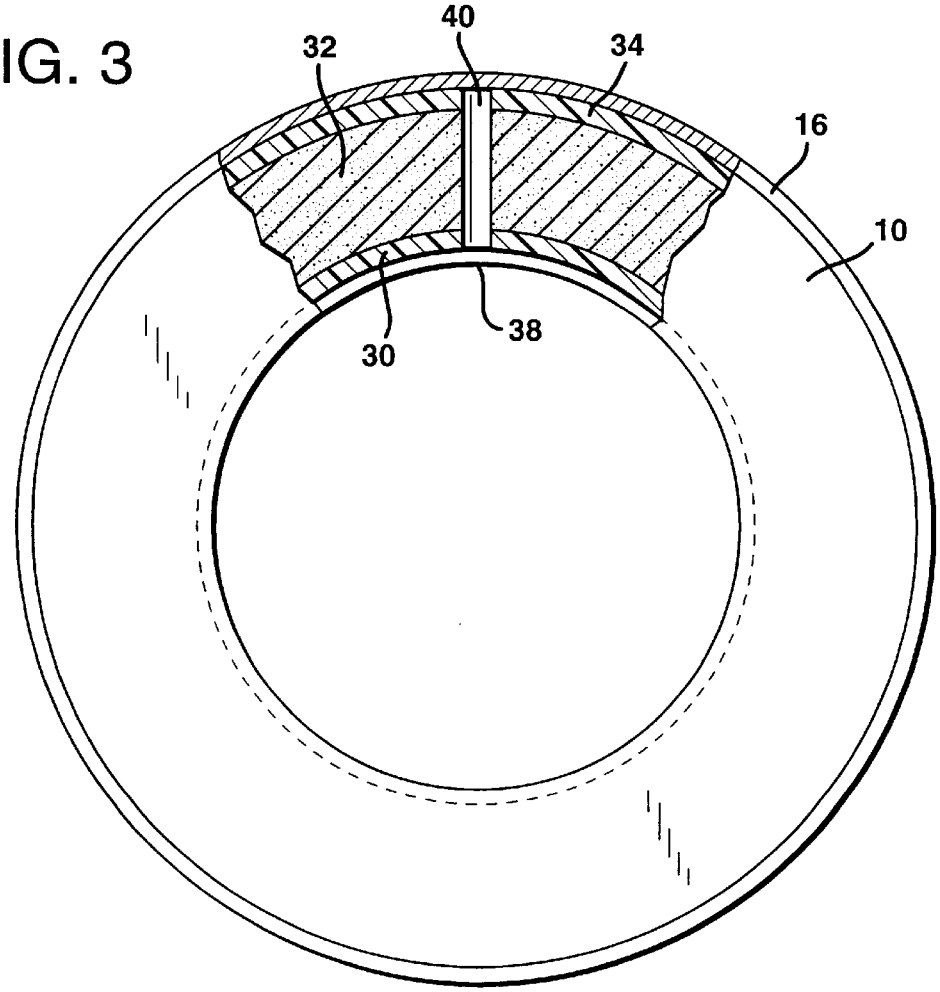
FIG. 3 is an end view, in partial section of another embodiment of the mandrel of the present invention illustrating the orifices and layered construction of this embodiment of the mandrel.

Bridge mandrel 10 may comprise a rigid material such as, for example, a metal or rigid polymer. In a preferred embodiment as illustrated in FIG. 3, bridge mandrel 10 comprises a base layer 30, an intermediate layer 32, and a surface layer 34. Preferably, base layer 30 and surface layer 34 comprise rigid materials such as metal or rigid polymers. In a preferred form, base layer 30 comprises a polyester which may be reinforced with glass or other high tensile strength fibers. Intermediate layer 32 comprises a polymer foam such as a polyurethane foam which may be either rigid or compressible. Surface layer 34 is also preferably a rigid polymer such as a polyester or polyurethane. Surface layer 34 is preferably machined or molded to provide a smooth surface over which print sleeve 16 is mounted. This combination of materials provides mandrel 10 with a combination of strength and rigidity, but with light weight for ease of handling. mandrel 10 with a combination of strength and rigidity, but with light weight for ease of handling.

As is known in the art, printing sleeve 16 is typically fabricated from a material which is expandable under suitable air pressure of less than about 100 pounds per square inch (690 MPa). Printing sleeve 16 may be comprised of a single material such as a polymer or thin metal, or may be a composite or laminate structure. Printing plate 18, as is conventional, is fabricated of an elastomeric material and is adhered to the surface of sleeve 16.

Figure 2:
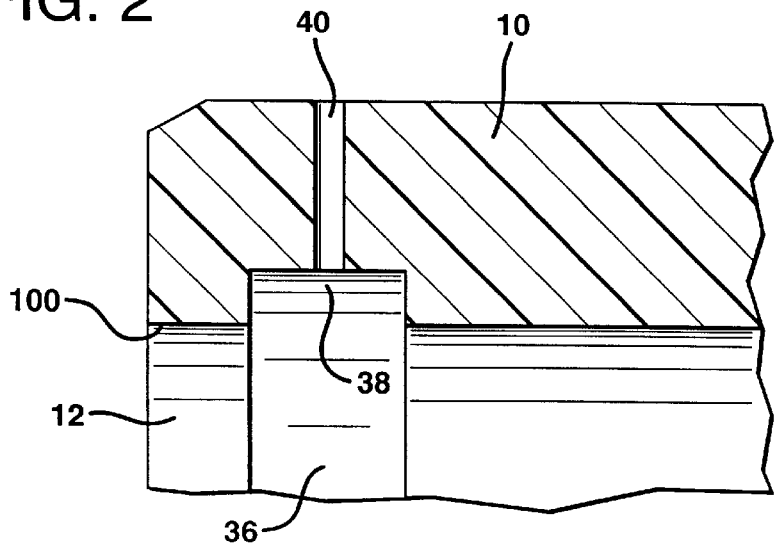
FIG. 2 is an enlarged side view, in section, illustrating the channel and an orifice at one end of the mandrel.

Assembly of bridge mandrel 10 and printing cylinder 12 is as described above. Mounting of printing sleeve 16 and printing plate 18 are accomplished by supplying air under pressure to the interior of printing cylinder 12. Printing cylinder 12 is equipped with a plurality of air passageways 36 which provide a path to the exterior surface of printing cylinder 12 as best shown in FIGS. 1 and 2. Pressurized air flows through passageways 36 and into channel 38 which extends at least partially, and preferably completely, around the circumference of the inner surface 100 of bridge mandrel 10. From channel 38, the air flows through the plurality of orifices 40 in mandrel 10 to the outer surface 102 of the mandrel. There, the pressurized air acts to expand sleeve 16 slightly, enough to permit sleeve 16 to slide easily along the length of mandrel 10 until it is completely mounted as illustrated in FIGS. 1 and 5. Once the air pressure is removed, sleeve 16 contracts to form a tight friction fit with mandrel 10.

Channel 38 preferably has a depth of between about 0.05 to about 0.5 mm and a width of from about 1 to about 20 mm. Orifices 40 have a diameter of from about 1.0 to about 2.5 mm. The location of channel 38 in mandrel 10 is designed so that when mandrel 10 is mounted onto print cylinder 12, channel 38 is over the outlets for air passageways 36. Because channel 38 is recessed inwardly from the first end 104 of bridge mandrel 10, there is a substantially air-tight seal between inner surface 100 of bridge mandrel 10 and the outer surface of print cylinder 12 so that nearly no air escapes. Further, because the channel extends around the circumference of the inner surface of mandrel 10, there is no need to align the orifices 40 with air passageways 36 on the print cylinder. Thus, the bridge mandrel of the present invention can be used on numerous print cylinders in the industry.

The bridge mandrel of the present invention may be manufactured in many sizes and outer diameters to accommodate a variety of different image repeats as is now common in this industry. For example, the length of the bridge mandrel may vary between about 200 to up to about 4000 mm, while the wall thickness of the mandrel may be as little as about 2 mm in some embodiments to thicknesses up to and including about 100 mm. For the embodiment of the mandrel which includes a locking mechanism, the wall thickness needs to be increased slightly to accommodate the mechanism. In those embodiments, the minimum wall thick is typically about 7 mm or greater.

While certain representative embodiments and details have been shown for purposes of illustrating the invention, it will be apparent to those skilled in the art that various changes in the methods and apparatus disclosed herein may be made without departing from the scope of the invention, which is defined in the appended claims.

What is claimed is:

1. A bridge mandrel comprising a generally hollow, cylindrically-shaped tube adapted to fit over a print cylinder, said tube having an inner surface and an outer surface, a first end and a second end, a channel extending substantially around the circumference of said inner surface of said tube, a plurality of orifices extending generally radially outwardly from said channel to said outer surface of said tube, and a C-shaped notch on said inner surface of said tube for locking said tube onto said print cylinder, said notch including a sidewall, a back wall, and a laterally-extending wall opposite said back wall.

2. A bridge mandrel as claimed in claim 1 in which said channel is located adjacent said first end of said tube.

3. A bridge mandrel as claimed in claim 1 in which said tube includes a base layer, an intermediate layer, and a surface layer.

4. A bridge mandrel as claimed in claim 3 in which said base layer comprises a metal or a rigid polymer.

5. A bridge mandrel as claimed in claim 3 in which said intermediate layer comprises a foamed polymeric material.

6. A bridge mandrel as claimed in claim 3 in which said surface layer comprises a rigid polymer.

7. A bridge mandrel as claimed in claim 1 in which said channel has a depth of between about 0.05 to about 0.5 mm.

8. A bridge mandrel as claimed in claim 1 in which said channel has a width of from between about 1 to about 20 mm.

9. A bridge mandrel as claimed in claim 1 in which said orifices have a diameter of between about 1.0 to about 2.5 mm.

10. In combination, a print cylinder and a bridge mandrel assembly, said bridge mandrel comprising a generally hollow, cylindrically-shaped tube adapted to fit over said print cylinder, said tube having an inner surface and an outer surface, a first end and a second end, a channel extending substantially around the circumference of said inner surface of said tube, and a plurality of orifices extending generally radially outwardly from said channel to said outer surface of said tube, and a C-shaped notch on said inner surface of said tube for locking said tube onto said print cylinder, said notch including a sidewall, a back wall, and a laterally-extending wall opposite said back wall.

11. A bridge mandrel comprising a generally hollow, cylindrically-shaped tube adapted to fit over a print cylinder, said tube having an inner surface and an outer surface, a first end and a second end, a channel extending substantially around the circumference of said inner surface of said tube, a plurality of orifices extending generally radially outwardly from said channel to said outer surface of said tube, and a locking mechanism on said inner surface of said tube, said locking mechanism comprising a C-shaped notch for locking said tube onto said print cylinder, said C-shaped notch including a sidewall, a back wall, and a laterally-extending wall opposite said back wall.

12. A bridge mandrel as claimed in claim 11 in which said tube comprises a base layer, an intermediate layer comprising a foamed polymeric material, and a surface layer.

13. A bridge mandrel as claimed in claim 12 in which said base layer comprises a metal or rigid polymer.

14. A bridge mandrel as claimed in claim 12 in which said surface layer comprises a rigid polymer.

* * * * *

UNITED STATES PATENT AND TRADEMARK OFFICE

CERTIFICATE OF CORRECTION

PATENT NO. : 6,360,662 B1
DATED : March 26, 2002
INVENTOR(S) : Mario Busshoff

It is certified that error appears in the above-identified patent and that said Letters Patent is hereby corrected as shown below:

Column 5,
Line 20, "of handling. mandrel 10 with a combination of strength and rigidity, but with light weight for ease of handling." should be -- of handling. --

Signed and Sealed this

Tenth Day of December, 2002

JAMES E. ROGAN
*Director of the United States Patent and Trademark Office*